US005590555A

United States Patent [19]

Kester et al.

[11] Patent Number: 5,590,555

[45] Date of Patent: Jan. 7, 1997

[54] ANTI-ROTATION MECHANISM FOR LOCKSET CHASSIS

[75] Inventors: Steven A. Kester, Noblesville; Scott A. Gilbertson, Indianapolis; John W. McIntire, Anderson, all of Ind.

[73] Assignee: Best Lock Corporation, Indianapolis, Ind.

[21] Appl. No.: 431,445

[22] Filed: May 1, 1995

[51] Int. Cl.[6] ..... E05B 9/06

[52] U.S. Cl. ..... 70/224; 70/451; 70/452; 292/336.3; 292/356; 292/357

[58] Field of Search ..... 70/224, 370, 449, 70/451, 452; 292/336.3, 356, 357, DIG. 53, DIG. 64

[56] References Cited

U.S. PATENT DOCUMENTS

| | | | |
|---|---|---|---|
| 48,023 | 5/1865 | Nobles | 292/357 |
| 1,461,756 | 7/1923 | Croning | 70/451 |
| 1,629,172 | 5/1927 | Murphy | 70/370 |
| 1,938,112 | 12/1933 | Schlage | 70/452 |
| 2,723,874 | 11/1955 | Hillgren | 292/336.3 |
| 2,733,946 | 2/1956 | North et al. | 292/336.3 |
| 3,139,134 | 6/1964 | Russell et al. | 292/357 |
| 3,955,387 | 5/1976 | Best et al. | 70/224 |
| 4,067,599 | 1/1978 | Ohno | 292/357 X |
| 4,424,691 | 1/1984 | Foshee | 70/224 |
| 4,428,212 | 1/1984 | Best et al. | 70/224 |
| 4,437,695 | 3/1984 | Foshee | 292/352 |
| 4,604,879 | 8/1986 | Neary et al. | 70/224 |
| 4,655,059 | 4/1987 | Best et al. | 70/224 |
| 4,869,083 | 9/1989 | DeMarseilles et al. | 70/224 |
| 4,920,773 | 5/1990 | Surko, Jr. | 70/224 |
| 4,998,760 | 3/1991 | Nixon et al. | 292/347 |
| 5,116,170 | 5/1992 | Palmer et al. | 408/72 B |
| 5,149,155 | 9/1992 | Caeti et al. | 292/336.3 |
| 5,236,235 | 8/1993 | Gustafson et al. | 292/357 |

FOREIGN PATENT DOCUMENTS

| | | | |
|---|---|---|---|
| 105661 | 11/1938 | Australia | 70/451 |

*Primary Examiner*—Lloyd A. Gall
*Attorney, Agent, or Firm*—Barnes & Thornburg

[57] ABSTRACT

A lockset chassis assembly is provided for use with a door latch. The lockset chassis assembly includes a rotatable spindle, a chassis supporting the rotatable spindle, a rose engaging the chassis at a junction therebetween and defining a space between the rose and the chassis at the junction, and a locking pin. The chassis includes an inner hub and an outer hub separated from the inner hub. The outer hub includes a threaded outer surface and an outer hub keyway interrupting the threaded outer surface. The locking pin engages the inner hub, lies in the outer hub keyway, and engages the rose and the chassis in the space at the junction between the rose and the chassis.

25 Claims, 4 Drawing Sheets

54
52
130
68
16
12
132
126
34
36
20
58
128
22
50
26
70
110
76
72
64
60
62
92
74
73
28
24
86
30
84
90
88
40
38
18
80
94
122
82
118
10
124
42
44
46
14

ANTI-ROTATION MECHANISM FOR LOCKSET CHASSIS

BACKGROUND AND SUMMARY OF THE INVENTION

The present invention relates to a lockset for use in a door, and particularly to a door-mounted cylindrical lockset having a chassis for mounting in the door, a door handle coupled to a door latch-operating mechanism housed in the chassis, and a rose assembly anchored to the door and arranged to cover the connection between the door handle and the door latch-operating mechanism. More particularly, the present invention relates to an anti-rotation mechanism for locking the chassis to the anchored rose assembly to anchor the chassis to the door.

Cylindrical lockets are well known. See, for example, U.S. Pat. No. 3,955,387 to Best et al; U.S. Pat. Nos. 4,424,691 and 4,437,695 to Foshee; and U.S. Pat. No. 4,920,773 to Surko, Jr. A cylindrical lockset connects a door handle to a retractable latch bolt mounted in a door so that the door handle can be turned to retract the latch bolt and unlatch the door. Typically, a cylindrical lockset is mounted in a lockset-receiving aperture provided in a door.

The latch bolt is mounted for sliding movement in a horizontal passage formed in the door. The horizontal passage has a first opening at one end in a vertical edge of the door and a second opening at the other end communicating with the lockset-receiving aperture formed in the door. The latch bolt is normally biased by a spring to a projected position latching the door. The latch bolt is moved against the spring to a retracted position inside the horizontal passage by the cylindrical lockset once the door handle is turned properly by a user.

Each cylindrical lockset includes various mechanical linkages and locking mechanisms mounted inside the lockset-receiving aperture formed in the door and used to control operation of a latch bolt retractor coupled to the latch bolt. An outer portion of the cylindrical lockset carries an outside door handle (e.g., knob or lever arm) and an inner portion of the cylindrical lockset carries an inside door handle.

To open a door, a user can turn either the inside or outside door handle to operate the mechanical linkage mounted inside the cylindrical lockset. This action enables a user to retract a spring-biased latch bolt mounted in the horizontal passage and connected to the cylindrical lockset from a projected position extending beyond the vertical edge of the door and engaging a side slot formed in a door jamb to a retracted position inside the door. The user is now free to swing the door on its hinges from a closed position to an opened position.

A lever-handled lockset is susceptible to "overtorquing" damage during an attack. If an intruder applies excessive torque to a locked cylindrical lockset, in some cases, the intruder can break or damage the lockset by rotating the lockset chassis. The chassis is typically mounted in the lockset-receiving aperture formed in the door and configured to hold a door latch-operating mechanical linkage in place in the door. By forcibly rotating the lockset chassis, the intruder may be able to damage the lockset enough to break the lock mechanism in the lockset and open a previously locked door.

It is known to provide a mechanism in a lockset for blocking rotation of the lockset chassis in the door. See, for example, U.S. Pat. Nos. 3,955,387 to Best; 4,604,879 to Neary; 4,869,083 to DeMarseilles; and 5,149,155 to Caeti.

What is needed is a sturdy anti-rotation mechanism for locking a lockset chassis in a door against rotation during an attack on the lock by an intruder. Security personnel would appreciate an improved lockset chassis anti-rotation mechanism that is configured to minimize chassis rotation by strengthening the connection anchoring the chassis to the door. By minimizing chassis rotation during an attack on the lockset, overtorquing damage to the lockset can be minimized.

According to the present invention, a lockset chassis assembly includes a rotatable latch-operating spindle, a chassis supporting the spindle, a rose engaging the chassis and surrounding the spindle, and a locking pin engaging the chassis and the rose to block rotation of the chassis relative to the rose about the longitudinal axis of the spindle. The rose can be anchored to a door in which the lockset chassis assembly is mounted.

A chassis keyway is formed in the chassis and a rose keyway is formed in the rose and these two keyways cooperate to define a locking pin-receiving port therebetween. The locking pin passes through this port and engages both the chassis and the rose. Such engagement functions to lock the chassis to the rose (which is anchored to the door) to block unwanted rotation of the chassis relative to the door during an attack on the lockset.

In preferred embodiments, the chassis includes an outer hub coupled to an inner hub to position a latch retractor assembly therebetween. Also, an outer rose is mounted on the outer hub and an inner rose is mounted on the inner hub. The outer hub includes a threaded outer surface for rotatably engaging threads formed in a central aperture provided in the outer rose. The inner hub also includes a threaded outer surface for receiving the inner rose.

Illustratively, the inner and outer hubs are each formed to include one portion of the chassis keyway. An inner portion of the chassis keyway is an axially extending channel that has a half-round shape and is formed in the inner hub to interrupt the threaded outer surface in the inner hub. An outer portion of the chassis keyway also is an axially extending channel that has a half-round shape and is formed in the outer hub to interrupt the threaded outer surface in the outer hub. When fully assembled, an axially outer end of the locking pin lies in the half-round channel formed in the outer hub, an axially inner end of the locking pin lies in the half-round channel formed in the inner hub, and a middle section of the locking pin passes over the latch retractor assembly that is mounted to lie between the spaced-apart inner and outer hubs.

In use, when torque is applied to an outer door handle mounted on the latch-operating spindle, the torque is transmitted through the chassis to the locking pin and the outer rose (which is anchored in a fixed position to the door) to stop the chassis from rotating. Thus, the lockset chassis is protected from overtorquing damage during an attack. The locking pin is made of steel and has a head portion at its axially inner end and an outer rose-engaging foot portion at its axially outer end. The outer rose-engaging foot portion lies in a first half-round keyway formed in the outer hub and adjacent to the outer rose and the head portion lies in another half-round keyway formed in the inner hub and aligned in collinear relation with the first half-round keyway.

The inner and outer hubs are preferably investment castings made of steel. The outer rose includes a rose liner that is a stamped steel part that screws onto the outer hub and defines the rose keyway and a shell-like rose cover that surrounds the door handle shaft and mounts on the rose liner. When the rose keyway on the outer rose and the outer portion of the chassis keyway on the outer hub are in alignment facing one another, the locking pin is biased by a compression spring into the locking pin-receiving port defined by those two keyways to lock the chassis to the outer rose, thereby blocking rotation of the chassis relative to the door. Illustratively, the compression spring is carried on the locking pin and positioned to lie between the inner and outer hubs. The rose liner is stopped from rotating relative to the door by steel studs that are riveted onto the rose liner and protrude into holes that have been drilled out in the door.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
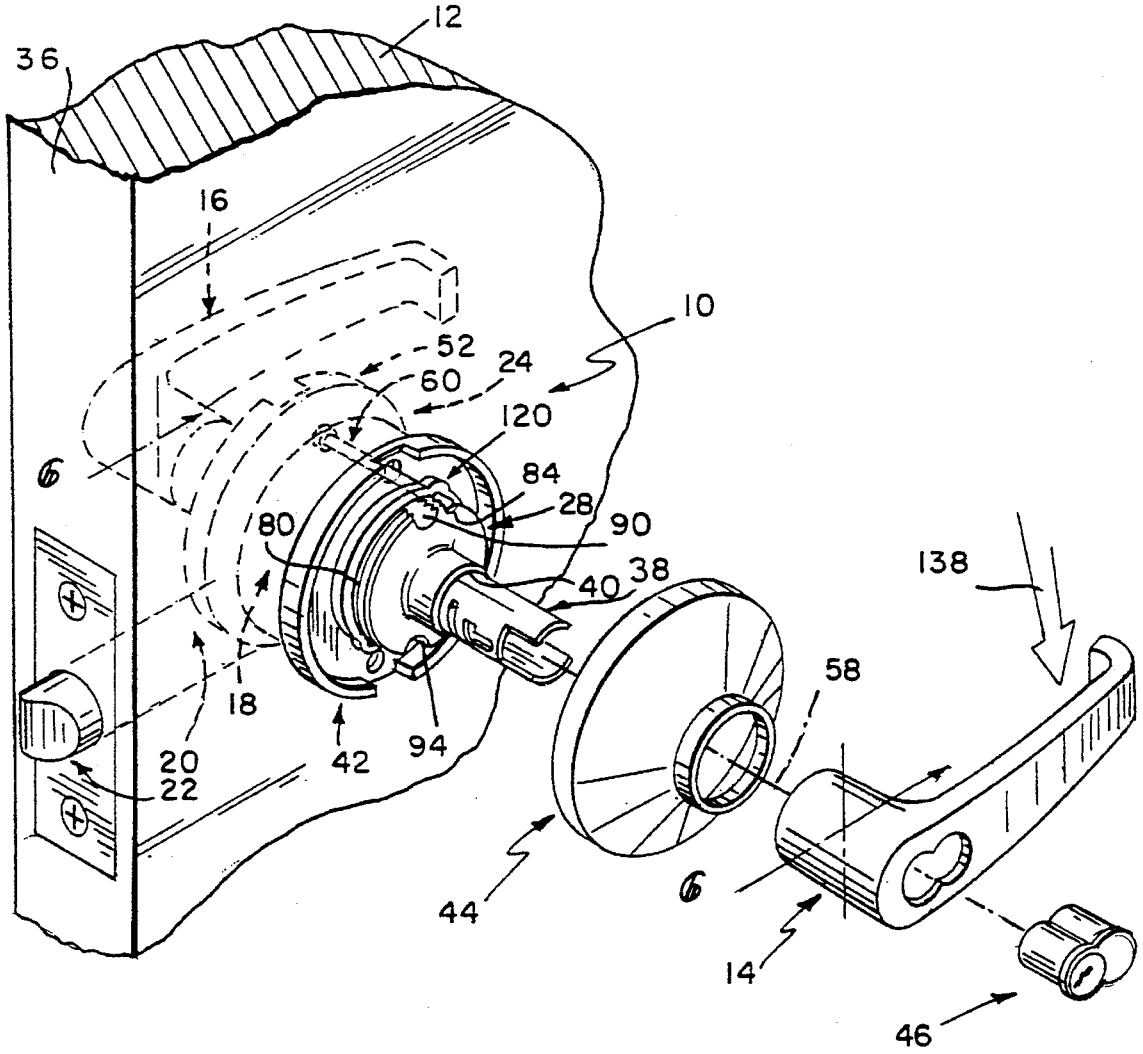
FIG. 1 is a perspective view of a cylindrical lockset including an anti-rotation mechanism in accordance with the present invention showing a lockset chassis mounted in a door, an outer rose liner mounted on the chassis and anchored to the door, a locking pin (shown in phantom) extending through the door and locking the chassis to the anchored rose liner, and a rotatable latch-operating spindle extending axially outwardly from the chassis to support an outer door handle.

A lever-handled cylindrical lockset 10 is mounted in a door 12 as shown in FIG. 1 and is used to latch and lock the door 12. The cylindrical lockset 10 includes an anti-rotation mechanism that is provided to enhance the security of the lockset 10 during an attack by an intruder. This anti-rotation mechanism is described herein and illustrated in the drawings. Recently, intruders have been attacking cylindrical locksets using "overtorquing" techniques.

Figure 2:
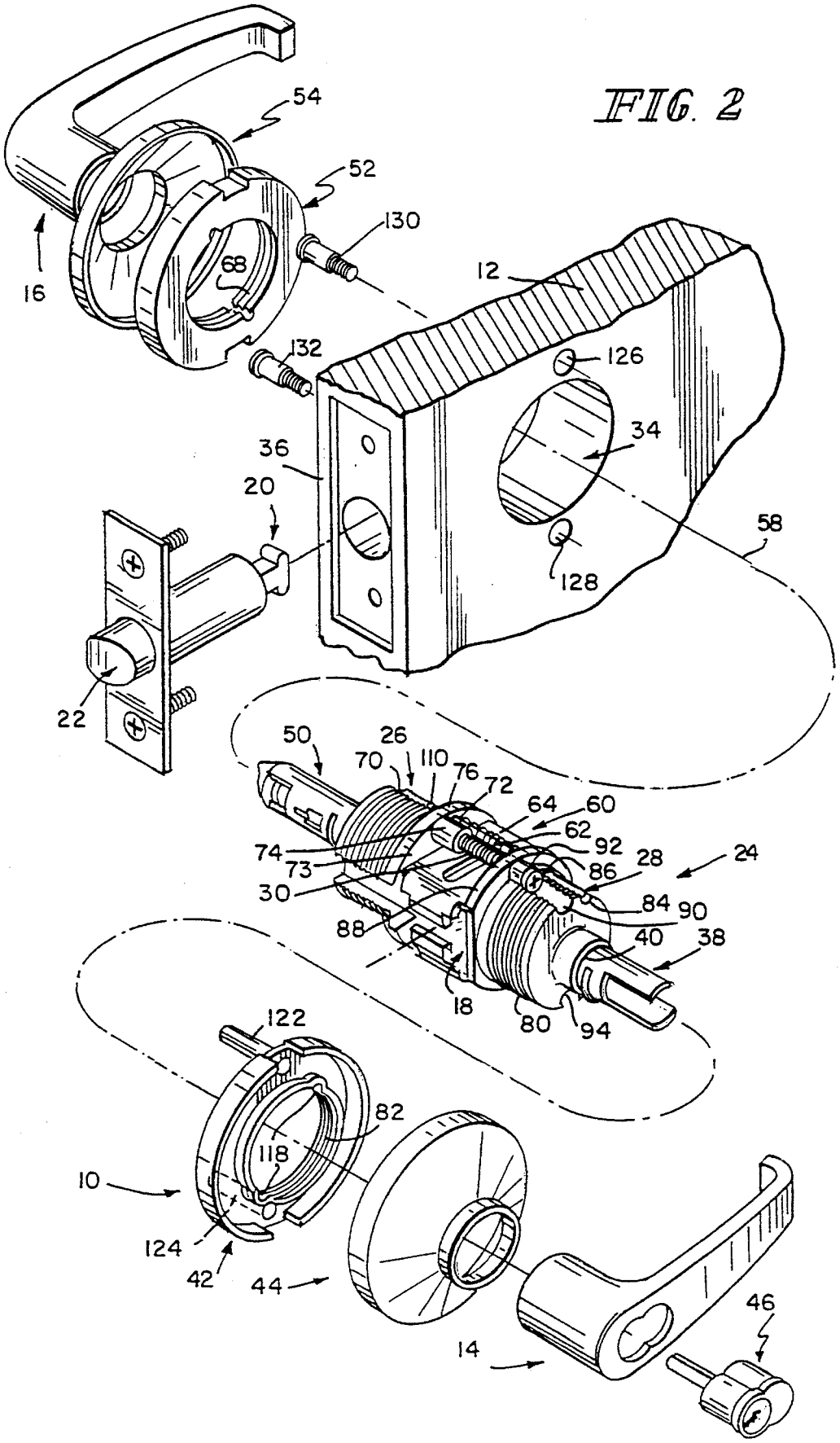
FIG. 2 is an exploded perspective view of the cylindrical lockset of FIG. 1 showing a door, a latch for mounting on an edge of the door, a chassis for mounting in an aperture formed in the door, the chassis including threaded inner and outer hubs and a latch retractor assembly therebetween, inner and outer spindles, an outer rose liner anchorable to the door, an outer rose cover attachable to the outer rose liner, an outer door handle attachable to the outer spindle, a lock core for mounting in the outer door handle and locking the latch retractor assembly, and a spring-biased locking pin carried on the far side of the chassis and movable to engage the outer rose liner.

The lockset 10 is operable by means of either an outer door handle 14 or an inner door handle 16 to operate a centrally located latch bolt retractor assembly 18. Referring to FIGS. 1 and 2, the latch bolt retractor assembly 18 is mounted in the door 12 and is connected to the tailpiece 20 of a spring-biased latch bolt 22. The latch bolt retractor assembly 18 can be operated to retract the latch bolt 22 from its projected position (shown in FIG. 1) engaging a door frame (not shown) to a retracted position (not shown) lying inside the door 12 and disengaging the door frame.

A lockset chassis 24 is shown prior to assembly in FIG. 2. Chassis 24 includes an inner hub 26, an outer hub 28, and a first bolt 30 (FIG. 2) and a second bolt 32 (FIG. 6) for coupling the inner and outer hubs 26, 28 together in spaced-apart relation to mount the latch retractor assembly 18 therebetween. The lockset chassis 24 is mountable in an aperture 34 formed in door 12 and arranged to lie adjacent to the vertical edge 36 of the door 12 in which the lockset 10 is mounted.

As shown in FIGS. 1 and 2, the lockset 10 also includes a rotatable outer spindle 38 arranged to extend through a central aperture 40 formed in the outer hub 28 and carry outer door handle 14, an outer rose liner 42 anchored to door 12 and positioned to surround outer hub 28, and an outer rose cover 44 coupled to outer rose liner 42. The outer rose liner 42 and the outer rose cover 44 cooperate to define the outer rose of lockset 10.

Figure 6:
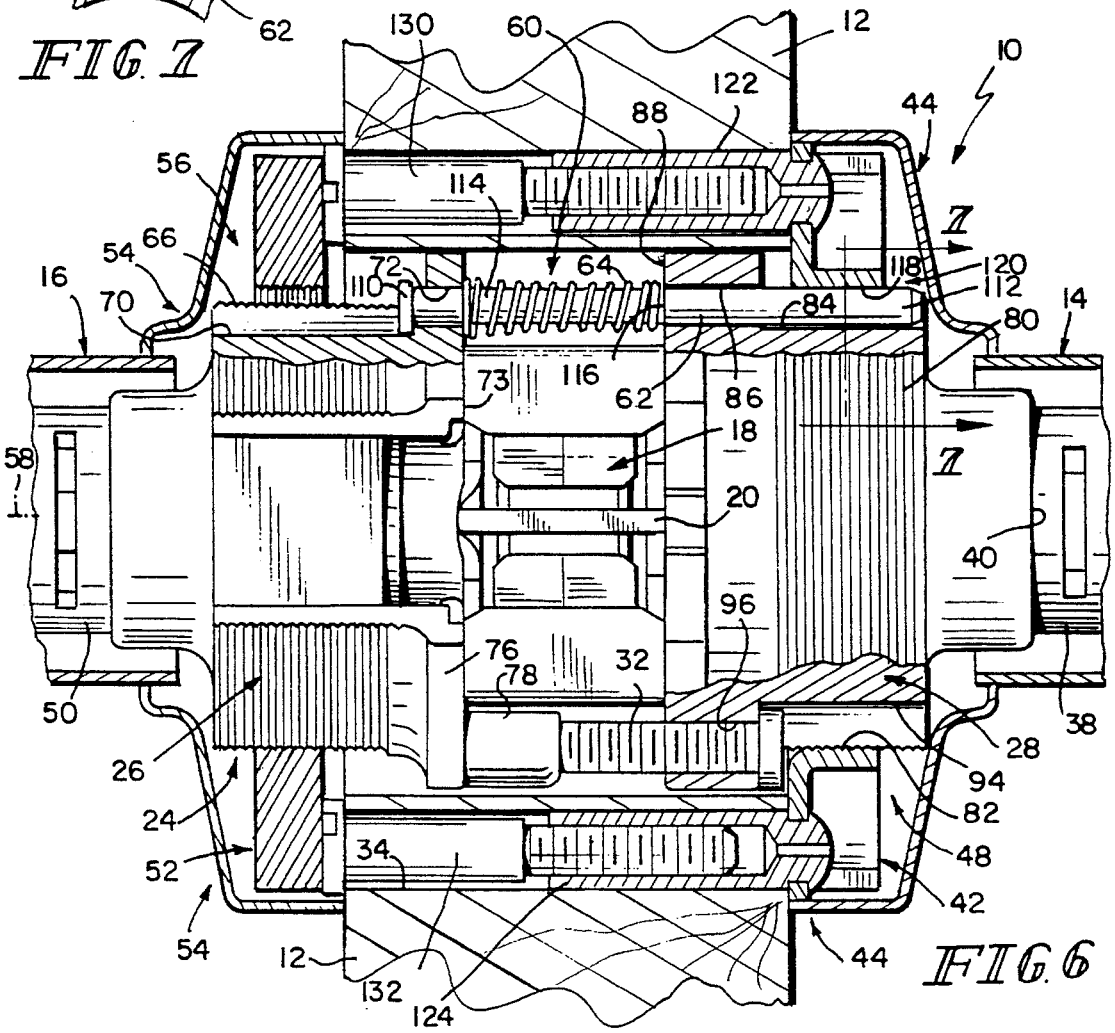
FIG. 6 is a sectional view taken along line 6—6 of FIG. 1 showing the locking pin lying in the locking pin-receiving port to interconnect the outer hub to the anchored outer retainer liner, thereby blocking rotation of the chassis relative to the door.

A key-removable figure-8-shaped lock core 46 is mountable in an aperture formed in the outer door handle 14. The outer spindle 38 passes through apertures formed in outer hub 28, outer rose liner 42, and outer rose cover 44. As shown in FIG. 6, the outer hub 28, outer rose liner 42, and outer rose cover 44 cooperate to define an interior region 48 therebetween that is empty.

Lockset 10 also includes a rotatable inner spindle 50 arranged to extend through a central aperture formed in the inner hub 26 and carry inner door handle 16, an inner rose liner 52 positioned to surround inner hub 26, and an inner rose cover 54 coupled to the inner rose liner 52 as shown in FIGS. 1 and 2. The inner hub 26, inner rose liner 52, and inner rose cover 54 cooperate to define an interior region 56 therebetween that is empty as shown in FIG. 6. Inner rose liner 52 is formed to include threaded inner edge 68 for engaging inner hub 26.

As described below, the outer rose liner 42 is anchored to the door 12 so that the outer rose liner 42 is fixed in the position shown in FIGS. 1 and 6 when the lockset 10 is mounted on the door 12. The chassis 24 is locked to the anchored outer rose liner 42 to block rotation of chassis 24 about longitudinal axis 58 during an attack on the lockset 10. This anti-rotation locking feature helps to minimize over-torquing damage to cylindrical lockset 10 during an attack.

Figure 3:
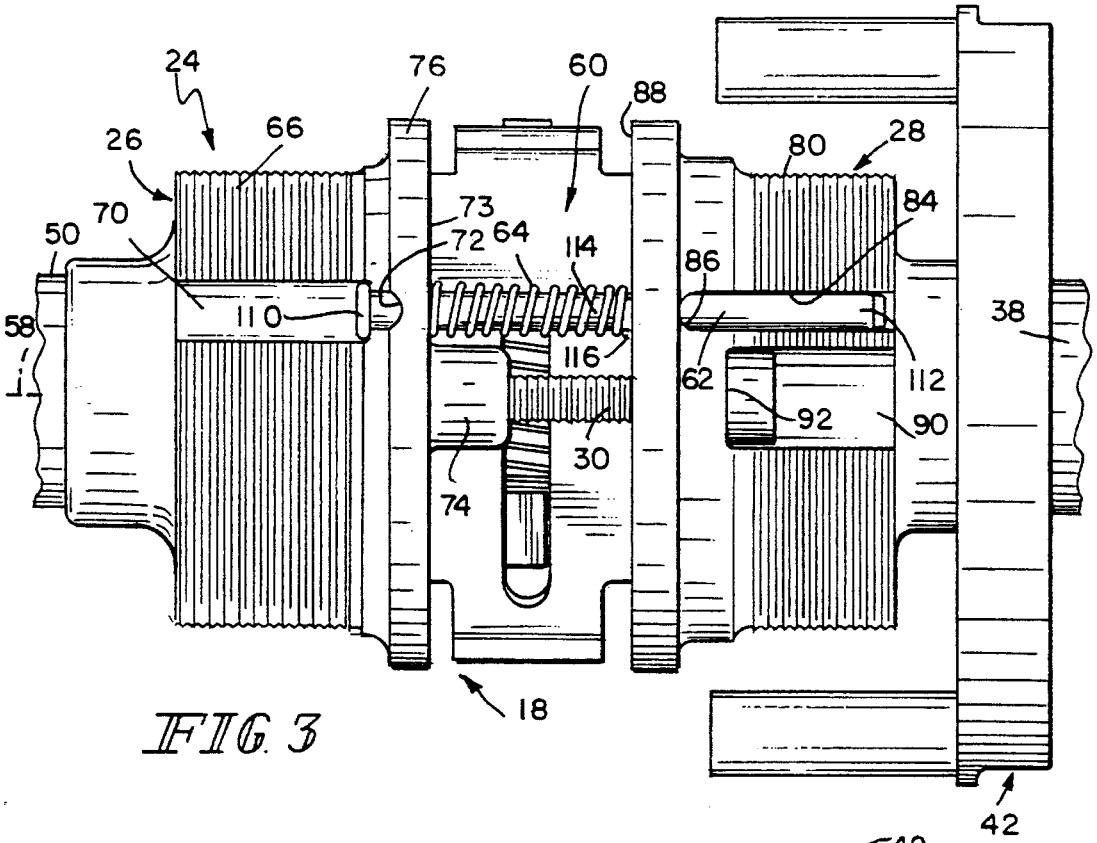
FIG. 3 is a top plan view of the chassis shown in FIG. 2 showing the outer rose liner as it is passed to the left along the outer spindle toward engagement with the threaded outer hub and showing the spring-biased locking pin lying in a projected position in half-round channels formed in the inner and outer hubs.
Figure 4:
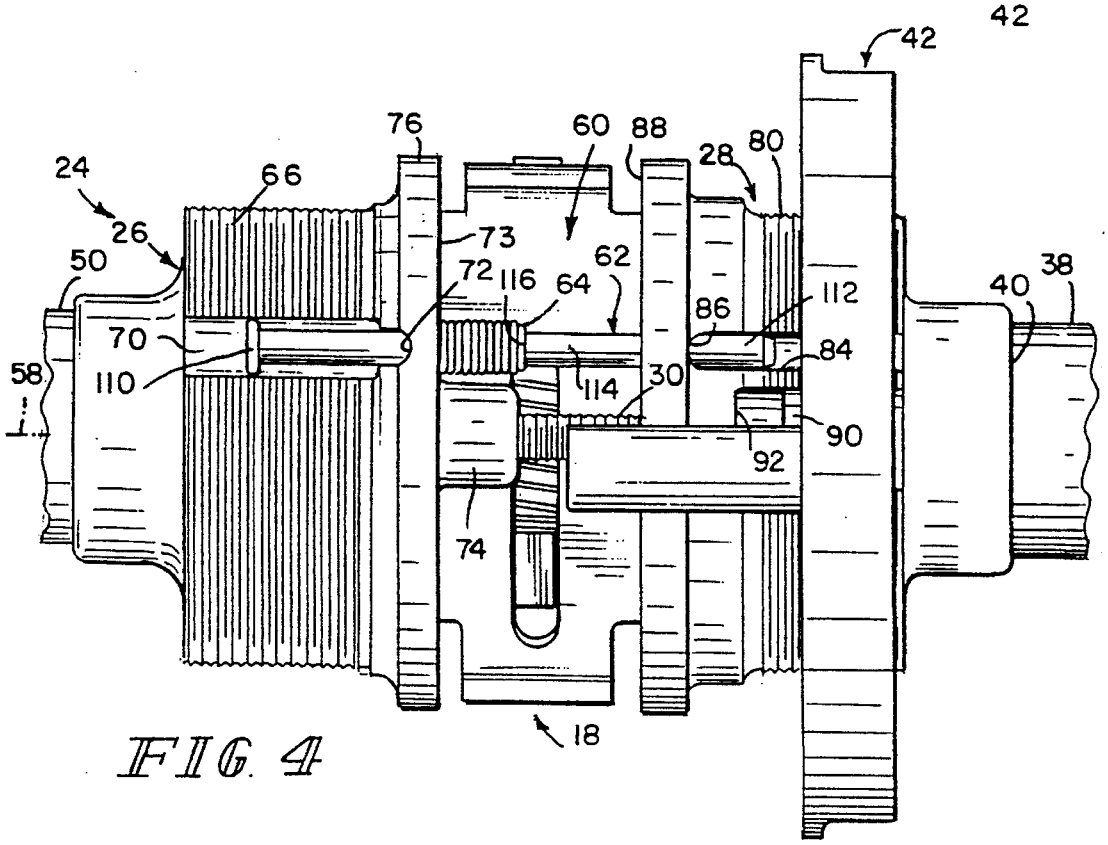
FIG. 4 is a view similar to FIG. 3 showing engagement of the outer rose liner on the threaded portion of the outer hub and retraction of the locking pin in the half-round channels formed in the inner and outer hubs and against the biasing spring positioned on the locking pin and arranged to lie between the inner and outer hubs.
Figure 5:
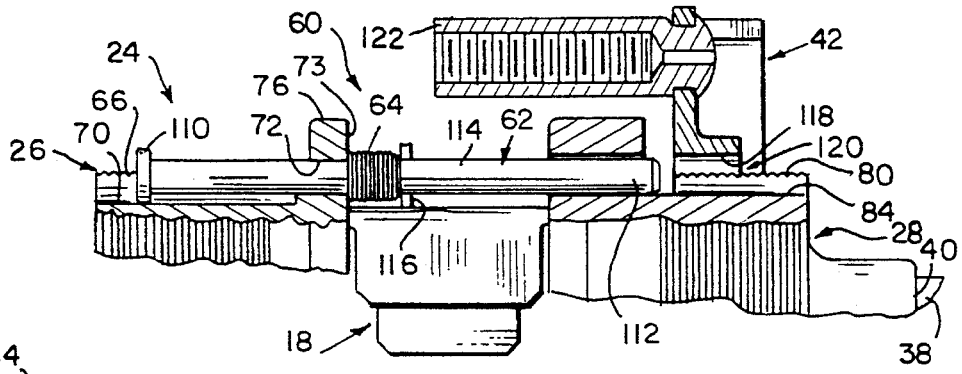
FIG. 5 is a side elevation of a portion of the lockset chassis assembly shown in FIG. 4 showing the lock pin-receiving port defined by a rose keyway formed in the outer rose liner and an outer portion of the chassis keyway formed in the outer hub while the locking pin is retained in a retracted position to disengage the lock pin-receiving port.

Anti-rotation mechanism 60 is coupled to the chassis 24 as shown best in FIGS. 2–4. Anti-rotation mechanism 60 includes a locking pin 62 and a pin-biasing spring 64. As shown in FIG. 6, the pin-biasing spring 64 normally urges locking pin 62 through channels and apertures formed in the chassis 24 to engage outer rose liner 42 to link the chassis 24 and anchored outer rose liner 42 together as a unit so that the chassis 24 cannot easily be rotated about the longitudinal axis 58 during an attack on the lockset 10. As shown in FIG. 5, the locking pin 62 can be withdrawn to a retracted position to disengage the outer rose liner 42 so that the outer rose liner 42 can rotate about longitudinal axis 58 relative to chassis 24 during authorized disengagement of outer rose liner 42 from chassis 24.

The channel and aperture system for guiding sliding movement of the reciprocable locking pin 62 in the chassis 24 is formed in inner hub 26 and outer hub 28, and also in outer rose liner 42. Half-round channels formed in the inner and outer hubs 26, 28 cooperate to define a chassis keyway split into two axially spaced apart sections 70, 84. A half-round cutout 118 formed in the outer rose liner 42 defines a rose keyway that communicates with the chassis keyway 70, 84 when the cylindrical lockset 10 is mounted in door 12, as shown in FIGS. 1 and 6. Alternatively, channels and apertures formed to receive reciprocable locking pin 62 therein could have square or rectangular shape instead of round or half-round shapes.

Outer hub 28 includes a cylindrical base having a threaded outer surface 80 for threadedly engaging an annular threaded inner edge 82 of outer rose liner 42. The outer hub 28 is formed to include a first half-round channel 84 that interrupts threads 80 and extends in spaced-apart parallel relation to longitudinal axis 58 and a pin-receiving aperture 86 at the end 88 of outer hub 28 that is positioned to lie next to latch bolt retractor assembly 18, as shown best in FIGS. 2 and 3. The outer hub 28 is also formed to include a larger diameter second half-round channel 90 lying in spaced-apart parallel relation to the first half-round channel 84 and a first bolt-receiving aperture 92 at outer hub end 88 for receiving first bolt 30 to facilitate a fixed coupling between the inner and outer hubs 26, 28. A third half-round channel 94 and a second bolt-receiving aperture 96 are formed in outer hub 28 as shown in FIG. 6 to receive second bolt 32.

The locking pin 62 includes a head portion 110 at one end, a rose liner-engaging foot portion 112 at its outer end, and a central portion 114 therebetween, as shown in FIGS. 3 and 4 (and in FIGS. 5 and 6). The locking pin 62 is reciprocable in the chassis keyway 70, 84 and arranged so that its head portion 110 lies in the half-round channel 70 formed in the inner hub 26 and its rose liner-engaging foot portion 112 lies in the first half-round channel 84 formed in the outer hub 28. The pin-biasing spring 64 is illustratively a coiled compression spring that is carried on the central portion 114 of the locking pin 62 and positioned to lie between the inner and outer hubs 26, 28. One end of pin-biasing spring 64 abuts the inner hub flange 76 and the other end of pin-biasing spring 64 is fixed to a stop 116 appended to the central portion 114 of the locking pin 62 as shown in FIGS. 3 and 4 (and in FIGS. 5 and 6).

Outer rose liner 42 is formed to include a pair of diametrically opposed half-round cutouts 118 along the annular threaded inner edge 82 as shown best in FIG. 2. One of these half-round cutouts 118 will function as a rose keyway by mating with the first half-round channel 84 (i.e., outer portion of the chassis keyway) once the outer rose liner 42 is properly mounted on the threaded outer hub 28 to define a locking pin-receiving port 120 as shown in FIGS. 1 and 5–7. The pin-biasing spring 64 normally biases the rose liner-engaging foot portion 112 of locking pin 62 into the locking pin-receiving port 120 to lock the chassis 24 against rotation relative to the outer rose liner 42 when the lockset 10 is properly mounted on door 12 as shown in FIGS. 1 and 6.

A pair of bolt-receiving anti-rotation studs 122, 124 are riveted onto the rose liner 42 as shown in FIG. 2. These anti-rotation studs 122, 124 are sized and arranged to fit into holes 126, 128 formed in door 12 on opposite sides of central chassis mounting aperture 34 as also shown in FIG. 2. During installation of lockset 10 in door 12, the anti-rotation studs 122, 124 are inserted into holes 126, 128 to block rotation of outer rose liner 42 about longitudinal axis 58 relative to door 12. Mounting bolts 130, 132 pass through holes 126, 128 formed in door 12 to engage the anti-rotation studs 122, 124, thereby securely anchoring the outer rose liner 42 to door 12.

Figure 7:
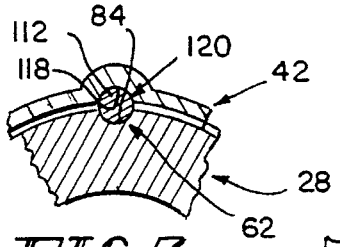
FIG. 7 is a sectional view taken along line 7—7 of FIG. 6 showing the locking pin in the locking pin-receiving port and lying in a half-round channel formed in the outer hub and in a mating half-round channel formed in the outer rose liner.

Someone attempting to gain unauthorized access through door 12 may place a large force 138 on outer door handle 14 to produce a large torque on lockset chassis 24 as shown in FIG. 1 in an effort to break lockset 10 during an attack. As shown in FIGS. 6 and 7, the locking pin 62 functions to lock the chassis 24 to the anchored outer rose liner 42 so that rotation of the chassis 24 relative to the rose liner 42 and door 12 about longitudinal axis. 58 is blocked. The anti-rotation mechanism 60 in lockset 10 advantageously minimizes chassis 24 rotation and strengthens the area that stops outer rose liner 42 from rotating during a lockset overtorquing attack carried out by an intruder. The design also eliminates a bending moment and creates a shear condition between outer rose liner 42 and outer hub 28 that is quite strong.

Although the invention has been described in detail with response to certain preferred embodiments, variations and modifications exist within the scope and spirit of the invention as described and defined in the following claims.

We claim:

1. A lockset chassis assembly for use with a door latch, the assembly comprising a rotatable spindle, a chassis supporting the rotatable spindle, the chassis being formed to include a threaded outer surface and a chassis keyway interrupting the threaded outer surface, a rose engaging the chassis, and a locking pin lying in the chassis keyway and engaging the rose to block rotation of the chassis relative to the rose, the locking pin including a shaft having an enlarged head lying in the chassis keyway and engaging only the chassis.

2. The assembly of claim 1, wherein the chassis includes an inner hub formed to include an inner portion of the chassis keyway and the enlarged head of the locking pin lies in the inner portion of the chassis keyway.

3. The assembly of claim 2, wherein the chassis further includes an outer hub coupled to the inner hub and formed to include an outer portion of the chassis keyway and the shaft further includes a rose-engaging foot portion lying in the outer portion of the chassis keyway in spaced-apart relation to the enlarged head.

4. A lockset chassis assembly for use with a door latch, the assembly comprising a rotatable spindle, a chassis supporting the rotatable spindle, the chassis including an inner hub and an outer hub separated from the inner hub, the outer hub including a threaded outer surface and an outer hub keyway interrupting the threaded outer surface, a rose engaging the chassis at a junction therebetween and defining a space between the rose and the chassis at the junction, and a locking pin engaging the inner hub, the locking pin lying in the outer hub keyway and the locking pin engaging the rose and the chassis in the space at the junction.

5. A lockset chassis assembly for use with a latch bolt retractor assembly to retract a door latch, the assembly comprising:

a rotatable latch-operating spindle having a longitudinal axis, a chassis supporting the rotatable latch-operating spindle, the chassis including an inner hub and an outer hub separated from the inner hub to define a space therebetween adapted to receive a latch bolt retractor assembly configured to engage the rotatable latch-operating spindle, the chassis having a threaded outer surface and being formed to include a chassis keyway interrupting the threaded outer surface, a rose engaging the chassis and providing a central aperture receiving the rotatable latch-operating spindle, the rose being formed to include a rose keyway, the rose being positioned on the chassis to align the rose keyway in confronting relation to the chassis keyway to define a locking pin-receiving port therebetween, and a locking pin passing through the space between the inner and outer hubs and the locking pin-receiving port to engage the chassis and the rose to block rotation of the chassis relative to the rose about the longitudinal axis.

6. The assembly of claim 5, wherein the outer hub includes a cylindrical base having the threaded outer surface and an annular flange appended to the cylindrical base and the cylindrical base is formed to include a portion of the chassis keyway.

7. The assembly of claim 6, wherein the hub is a unitary member made of cast steel.

8. The assembly of claim 6, wherein the portion of the chassis keyway is defined by an elongated half-round channel extending in spaced-apart parallel relation to the longitudinal axis of the rotatable latch-operating spindle.

9. The assembly of claim 8, wherein the rose includes an annular liner having a flat portion for abutting a door carrying the chassis and a pair of door-engaging studs appended to the flat portion and the flat portion is formed to include an annular inner edge defining a hub-receiving aperture receiving the cylindrical base therein and a semicircular cutout situated along the inner edge and configured to open toward the hub-receiving aperture and define the rose keyway.

10. The assembly of claim 8, wherein the rose includes a plate oriented to lie in orthogonal relation to the longitudinal axis and the plate includes a half-round edge defining the rose keyway.

11. A lockset chassis assembly for use with a door latch, the assembly comprising a rotatable latch-operating spindle having a longitudinal axis, a chassis supporting the rotatable latch-operating spindle, the chassis having a threaded outer surface and being formed to include a chassis keyway interrupting the threaded outer surface, a rose engaging the chassis and providing a central aperture receiving the rotatable latch-operating spindle, the rose being formed to include a rose keyway, the rose being positioned on the chassis to align the rose keyway in confronting relation to the chassis keyway to define a locking pin-receiving port therebetween, and a locking pin passing through the locking pin-receiving port to engage the chassis and the rose to block rotation of the chassis relative to the rose about the longitudinal axis, the chassis including a hub having a cylindrical base and an annular flange appended to the cylindrical base, the cylindrical base being formed to include a portion of the chassis keyway, and further comprising spring means for yieldably biasing the locking pin from an unlocking position lying in the chassis keyway in spaced-apart relation to the locking pin-receiving port to a locking position lying in the chassis keyway and passing into the locking pin-receiving port.

12. A lockset chassis assembly for use with a door latch, the assembly comprising a rotatable latch-operating spindle having a longitudinal axis, a chassis supporting the rotatable latch-operating spindle, the chassis being formed to include a chassis keyway, a rose engaging the chassis and providing a central aperture receiving the rotatable latch-operating spindle, the rose being formed to include a rose keyway, the rose being positioned on the chassis to align the rose keyway in confronting relation to the chassis keyway to define a locking pin-receiving port therebetween, and a locking pin passing through the locking pin-receiving port to engage the chassis and the rose to block rotation of the chassis relative to the rose about the longitudinal axis, the chassis including an inner hub and an outer hub coupled to the inner hub, the inner hub including a cylindrical base and an annular flange appended to the cylindrical base, the cylindrical base of the inner hub being formed to include an inner portion of the chassis keyway, the annular flange of the inner hub being formed to include first means for slidably receiving the locking pin, the outer hub including a cylindrical base and an annular flange appended to the cylindrical base of the outer hub, the cylindrical base of the outer hub being formed to include an outer portion of the chassis keyway, the annular flange of the outer hub being formed to include second means for slidably receiving the locking pin, and the outer portion of the chassis keyway cooperating with the rose keyway to define the locking pin-receiving port.

13. The assembly of claim 12, wherein the outer hub includes a threaded outer surface rotatably engaging a threaded inner surface of the rose and the outer portion of the chassis keyway is formed in the outer hub to interrupt the threaded outer surface.

14. The assembly of claim 13, wherein the inner hub includes a threaded outer surface and the inner portion of the chassis keyway is formed in the inner hub to interrupt the threaded outer surface.

15. The assembly of claim 12, wherein the annular flange of the outer hub is formed to include a locking pin-receiving aperture defining the second means and communicating with the outer portion of the chassis keyway.

16. The assembly of claim 12, wherein the inner hub includes a threaded outer surface and the inner portion of the chassis keyway is formed in the inner hub to interrupt the threaded outer surface.

17. A lockset chassis assembly for use with a door latch in a door having an outer surface, the assembly comprising a rotatable latch-operating spindle having a longitudinal axis, a chassis supporting the rotatable latch-operating spindle, the chassis including an inner hub and an outer hub separated from the inner hub, the outer hub including a threaded outer surface and an outer hub keyway formed in the outer hub to interrupt the threaded outer surface, a rose including an annular threaded inner surface engaging the threaded outer surface of the outer hub, the rose being formed to include a rose keyway, the rose being positioned on the chassis to align the rose keyway in confronting relation to the outer hub keyway to define a locking pin-receiving port therebetween, and a locking pin engaging the inner hub and lying in the outer hub keyway and passing through the locking pin-receiving port to engage the outer hub and the rose to block rotation of the chassis relative to the rose about the longitudinal axis.

18. The assembly of claim 17, wherein the rose includes a rose liner in threaded engagement with the threaded outer surface of the outer hub and the rose liner is formed to include a half-round cutout facing toward the outer hub keyway to define the locking pin-receiving port therebetween.

19. The assembly of claim 17, wherein the outer hub is a unitary member made of steel.

20. The assembly of claim 17, wherein the outer hub keyway is formed in the outer hub to extend in spaced-apart parallel relation to the longitudinal axis of the rotatable latch-operating spindle.

21. The assembly of claim 17, wherein the rose includes an annular liner having a flat portion for abutting a door carrying the chassis and a pair of door-engaging studs appended to the flat portion and the flat portion is formed to include an annular inner edge defining a hub-receiving aperture receiving the outer hub therein and a semicircular cutout situated along the inner edge and configured to open toward the hub-receiving aperture and define the rose keyway.

22. The assembly to claim 17, wherein the rose includes a plate oriented to lie in orthogonal relation to the longitudinal axis and the plate includes a half-round edge defining the rose keyway.

23. A lockset chassis assembly for use with a door latch, the assembly comprising:

a rotatable latch-operating spindle having a longitudinal axis, a chassis supporting the rotatable latch-operating spindle, the chassis including an outer hub including a threaded outer surface and an outer hub keyway formed in the outer hub to interrupt the threaded outer surface, a rose including an annular threaded inner surface engaging the threaded outer surface of the outer hub, the rose being formed to include a rose keyway, the rose being positioned on the chassis to align the rose keyway in confronting relation to the outer hub keyway to define a locking pin-receiving port therebetween, and a locking pin lying in the outer hub keyway and passing through the locking pin-receiving port to engage the outer hub and the rose to block rotation of the chassis relative to the rose about the longitudinal axis, the chassis further including an inner hub coupled to the outer hub, the inner hub including a threaded outer surface and an inner hub keyway formed in the outer surface of the inner hub, and the locking pin lying in the inner hub keyway.

24. The assembly of claim 23, wherein the inner hub includes a cylindrical base including the threaded outer surface and the inner hub keyway and an annular flange appended to the cylindrical base, the annular flange is formed to include an aperture positioned to lie at one end of the inner hub keyway, and the locking pin passes through the aperture.

25. A lockset chassis assembly for use with a door latch, the assembly comprising:

a rotational latch-operating spindle having a longitudinal axis, a chassis supporting the rotatable latch-operating spindle, the chassis including an outer hub including a threaded outer surface and an outer hub keyway formed in the outer hub to interrupt the threaded outer surface, a rose including an annular threaded inner surface engaging the threaded outer surface of the outer hub, the rose being formed to include a rose keyway, the rose being positioned on the chassis to align the rose keyway in confronting relation to the outer hub keyway to define a locking pin-receiving port therebetween, and locking pin lying in the outer hub keyway and passing through the locking pin-receiving port to engage the outer hub and the rose to block rotation of the chassis relative to the rose about the longitudinal axis, the outer hub including a cylindrical base including the threaded outer surface and the outer hub keyway and an annular flange appended to the cylindrical base, the annular flange being formed to include an aperture positioned to lie at one end of the outer hub keyway, and the locking pin passing through the aperture.

* * * * *